US006918411B2

(12) United States Patent
Berger et al.

(10) Patent No.: US 6,918,411 B2
(45) Date of Patent: Jul. 19, 2005

(54) RIBBON AND METHOD FOR PRODUCTION THEREOF

(75) Inventors: Johann Berger, Obere Schlossstrasse 114, Alfdorf (DE), 73553; Erich Reiter, Muntlangen (DE); Siegfried Hahn, Traun (AT); Günter Pedall, deceased, late of Münchberg (DE); by Ingeborg Genoveva Pedall, legal representative, Münchberg (DE)

(73) Assignee: Johann Berger, Alfdorf (DE)

( * ) Notice: Subject to any disclaimer, the term of this patent is extended or adjusted under 35 U.S.C. 154(b) by 262 days.

(21) Appl. No.: 10/168,559

(22) PCT Filed: Dec. 22, 2000

(86) PCT No.: PCT/EP00/13195

§ 371 (c)(1),
(2), (4) Date: Jun. 21, 2002

(87) PCT Pub. No.: WO01/48285

PCT Pub. Date: Jul. 5, 2001

(65) Prior Publication Data

US 2002/0189701 A1 Dec. 19, 2002

(30) Foreign Application Priority Data

Dec. 24, 1999 (DE) ..... 199 62 919
Sep. 15, 2000 (DE) ..... 100 45 718

(51) Int. Cl.[7] ..... D03D 39/10

(52) U.S. Cl. ..... 139/42 R; 139/42 A; 139/387 R; 139/388; 264/103; 264/127; 156/48

(58) Field of Search ..... 264/103, 127, 264/146–147, 126; 139/42 R, 42 A, 387 R, 388; 156/48, 155, 149, 308.2

(56) References Cited

U.S. PATENT DOCUMENTS 2,194,038 A * 3/1940 Wallace, Jr. ..... 139/387 R
4,755,242 A * 7/1988 Miller et al. ..... 156/88
4,901,769 A * 2/1990 Zollinger et al. ..... 139/434
4,957,144 A * 9/1990 Watanabe et al. ..... 139/434
4,957,145 A * 9/1990 Verclyte et al. ..... 139/434
5,139,859 A * 8/1992 Karvanen ..... 442/185
5,387,300 A * 2/1995 Kitamura ..... 156/148
5,562,967 A * 10/1996 Kikuchi et al. ..... 428/138
5,634,499 A * 6/1997 Kikuchi et al. ..... 139/387 R
5,759,924 A * 6/1998 Sahlin ..... 442/60
5,769,130 A 6/1998 Brielmann
6,289,942 B1 * 9/2001 Nakada et al. ..... 139/434
6,422,270 B2 * 7/2002 Nakada et al. ..... 139/434
6,675,837 B1 * 1/2004 Russ et al. ..... 139/11
6,705,354 B2 * 3/2004 Yama et al. ..... 139/434

FOREIGN PATENT DOCUMENTS

CH 598382 A 4/1978
EP 0034104 A1 8/1981
FR 2357674 A 2/1978
GB 119558 10/1918

* cited by examiner

*Primary Examiner*—Danny Worrell
*Assistant Examiner*—Robert H. Muromoto Jr.
(74) *Attorney, Agent, or Firm*—Banner & Witcoff, Ltd.

(57) ABSTRACT

A method and a device for the production of a ribbon are provided. The method may be performed on a narrow fabric needle loom and may include repeating the following steps: picking a weft thread (4), with (only) one weft needle (1); meshing the weft thread (4), with a catch thread (5), delivered from the side opposite the weft side (weft exit side), by a knitting needle (2) working on the weft exit side; returning the weft needle (1) and wrapping the weft thread (4), with a catch thread (6), delivered from the weft side by a knitting needle working on the weft side. The device may include a narrow fabric needle looms, for production of a ribbon, in particular by the above method. A webbing is also provided that may be produced from the above method.

16 Claims, 4 Drawing Sheets

RIBBON AND METHOD FOR PRODUCTION THEREOF

This is a U.S. National Phase Application Under 35 USC 371 and applicant herewith claims the benefit of priority of PCT/EP00/13195 filed Dec. 22, 2000, which was published Under PCT Article 21(2) in German and German Application Nos. 19962919.6 and 10045718.5 filed Dec. 24, 1999 and Sep. 15, 2000, respectively.

The invention relates to a method of producing webbing on a single-pick narrow fabric needle weaving machine and to a device on a narrow fabric needle weaving machine for implementing the method as well as to webbing produced thereby.

Numerous methods and devices are known for producing webbing. Use is made of machines having a single pick or two picks working in synchronism or opposingly to produce narrow fabric. As a rule the webbing achieved therewith has two edges differing in appearance, namely at the pick side and at the side opposite to the pick side, which is usually undesirable. This is why many more or less successful attempts have been made in making these differingly produced edges appear the same. However, the actual edge designs of the one or other side of the webbing also differ in their response to wear and tear.

Known from CH 598 382 A5 is a method of producing narrow fabrics having substantially the same edges on both sides in which the weft thread becomes crotcheted. Preferably disclosed is another variant of the method in which an auxiliary thread is included in the crotchet of the weft thread on one or both sides of the fabric. A webbing produced by ways and means as described in this patent has edges which become undesirably bulky due to crotcheting of the weft thread.

Described in EP 0 034 104 B1 is a method of producing a narrow fabric having a festoon edge or Barmeen sheet. In this method a single pick is used which is moved transversely for making a single pick for each stop in both directions, wherein periodically and alternatingly by means of the pick needle at least one warp thread not inline with the other warp threads is drawn in the middle of the open shed over the one or other edge of the warp thread shed, wherein alternatingly at the one or other edge once the weft thread and periodically the warp thread is worked along each edge with a needle and wherein the warp thread drawn outwardly and joined to the edge is released as soon as the pick needle and weft thread is moved transversely in the opposite sense. This method is exceptionally complicated and not suitable for producing automotive seat belt webbing.

Known also, as used in US vehicles, are belt webbings which although featuring at the weft entry side a tuck thread in thus possibly having a soft edge, comprise on the opposite side, however, hard monofil weft returns facing outwardly. The improvement already achieved in this case consisted of marking the differing edges by a warp thread of another color so that when assembling this belt webbing the hard side is oriented so that the soft edge always faces the neck of the vehicle occupant. Due to the high possibility of it ending up wrong, this procedure is, on the one hand, inexpedient and, on the other, hazardous.

One objective of the invention is to propose a method and a device for producing a webbing included a monofil weft thread which has soft, silky-smooth edges.

This objective is firstly achieved by a method as set forth in claim 1. The sequence of the steps in the method a) picking a weft thread with a pick needle, b) wrapping the weft thread with a tuck thread furnished from the side (weft exit side) opposite the pick side by means of a knitting needle working at the weft exit side, c) retracting the pick needle and d) wrapping the weft thread with a tuck thread furnished at the pick side by means of a knitting needle working at the pick side, whereby a monofil thread or a combination of multifil threads and monofil threads is used as the weft thread and whereby the tuck thread in step b) is looped with a blocking thread at weft exit side and/or at the pick side now makes it possible with a single pick needle to produce a narrow fabric which has substantially the same appearance at both woven edges.

In one aspect of the method in accordance with the invention a monofil thread is used as the weft thread. Webbing woven in accordance with this method contains substantially inelastic warp threads and is intended for automotive seat belts. It features the high remaining stiffness crosswise or high resilience transversely to the webbing as needed for this purpose and has soft edges despite the hard weft reversals. The soft edges are formed on both edges of the webbing by the loop-knitted course of tuck threads. For the tuck threads advantageously a (multifil) yarn is selected having a dtex the same or higher than that of the monofil weft thread. The advantage gained by this is that the monofil weft thread can be well covered with the tuck threads. The hard weft reversals of the monofil thread are softly concealed by the covering of the monofil tuck threads. The webbing is friendly to handle and despite the desired high stiffness crosswise is soft at the edges and has, since only monofil is employed as the weft thread, a very low webbing thickness for high stiffness crosswise. The firm weave in accordance with the invention results in a compact webbing having high resistance to wear and tear.

By the method in accordance with the invention to enhance reliable looping the knitted loops are preferably crotcheted at the weft exit side but also at the opposite side (weft entry side) with a blocking thread. In this arrangement the blocking thread is preferably presented so that it is not touched by the weft thread. In addition to assuring reliable looping the blocking thread gives added protection to the weft reversal loops. In this procedure the tuck thread is selected thinner and the blocking thread thicker to enhance protection.

In another advantageous aspect of the method in accordance with the invention the tuck thread is looped at both edges of the webbing with a blocking thread, whereby at at least one side of the webbing (weft entry side and/or weft exit side) between the warp threads with no wrapping of the weft material only one link to the legs of the loops of the tuck thread and the loop course, additional threads substantially located in parallel to the warp threads in the finished webbing of the course are included in the weave. In this arrangement the additional threads are not wrapped by the weft thread and each blocking thread of each knitting needle is presented such that it comes to rest totally outside of the additional threads at each edge of the webbing. This achieves an even softer edge covering the weft reversals of the "hard" monofil thread in further enhancing the handling comfort of such a webbing as compared to conventional webbing.

In yet another further advantageous embodiment of the method in accordance with the invention the weft thread is picked doubled or multipled. This results in the additional advantage of the weft thread then, of course, consisting of somewhat thinner individual monofil weft threads having added flexibility in the region of the weft reversals in being less bulky.

Another just as advantageous further embodiment of the method in accordance with the invention involves substantially fully-shrunk yarns being used for the tuck threads and/or the blocking threads and/or the additional threads in thus achieving an even smoother edge shape in eliminating practically all and any jutting of the webbing edge.

The term "monofil threads" selected in simplifying formulation covers both "true" monofils consisting of a sole capillary, as well as "mononfil-type" multifils, i.e. threads consisting of such compact guided individual capillaries that they, although actually multifil threads, have properties, such as e.g. pliancy, stiffness, less fluffiness, as are typical of monofil threads.

Further advantages and features of the invention read from the sub-claims.

For a better understanding of the invention, example embodiments thereof will now be detained with reference to the drawing in which.

Figure 1:
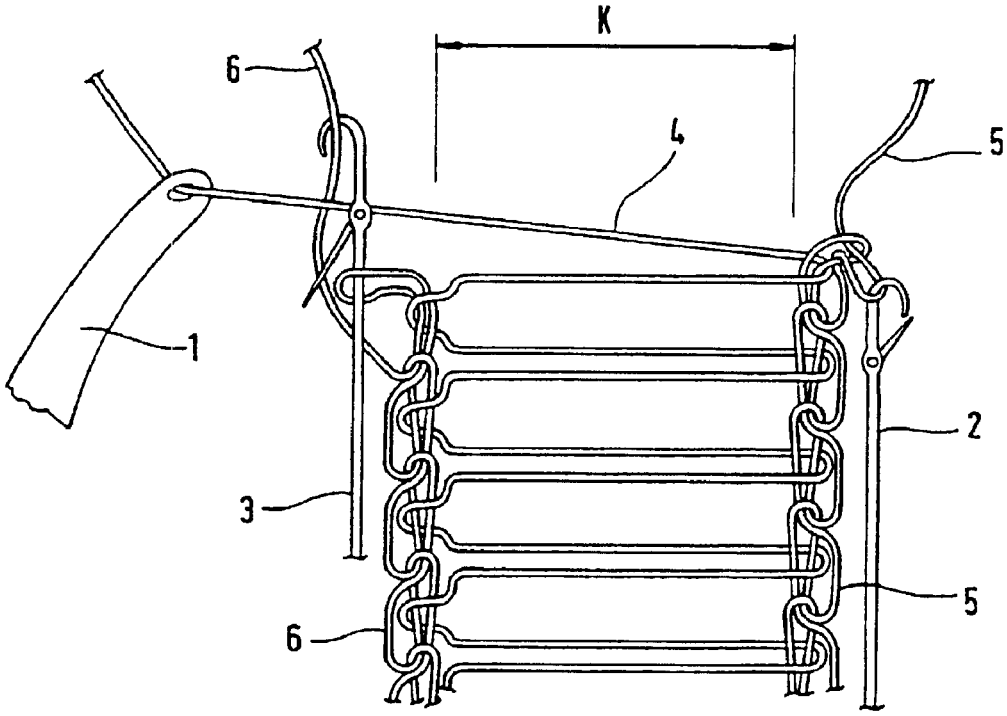
FIG. 1 is a greatly simplified diagrammatic section of a webbing woven by a method in accordance with the invention including courses of looped tuck threads, as well as pick needle and knitting needles, the warp threads irrelevant to the illustration being omitted to make for a better overview.

Referring now to FIG. 1 there is illustrated a greatly simplified diagrammatic section of a webbing woven by a method in accordance with the invention included courses of looped tuck threads, as well as pick needle 1 and knitting needles 2 and 3. The warp threads (not shown) run from bottom to top in a warp thread portion marked with a double-arrow K. The looped tuck threads shown to the left and right of the warp thread portion K are depicted extremely overdimensioned relative to the portion K to better illustrate the run of the looping of the tuck threads. It is to be noted that the illustration is not true-to-scale, portion K being in reality many times wider than shown here.

Evident on the left-hand side in FIG. 1 is a head of a pick needle 1, shown in part, carrying a weft thread 4 in its eyelet. The position of the pick needle 1 as shown in this case is the position in which the pick needle is located at the pick side roughly in the deadpoint for returning to the middle of the Figure in the direction of the opposite side. The weft thread 4 picked from left-to-right is looped with a tuck thread 5 on the right of a knitting needle 2 arranged on the right-hand side of the weaving machine. A knitting needle arranged on the left-hand side waits above the weft thread 4 and wraps it with the left-hand tuck thread 6. The tuck threads 5 and 6 are controlled by the tuckers (not shown) as known to the person skilled in the art. The device in accordance with the invention suitable for implementing the method in accordance with the invention is configured such that all movements of the left-hand knitting needle 3 and the left-hand tucker (not shown) can each be controlled irrelevant of the corresponding elements on the right-hand side (knitting needle 2 and right-hand tucker).

The terms denoting the orientation "right-hand", "left-hand", "front" and "rear" as selected in the present are always to be understood as relating to a portion as viewed by an observer standing in front of the narrow fabric needle weaving machine; it being just as possible that the complete arrangement and procedures are arranged or run vice-versa (right-hand/left-hand).

In one advantageous further embodiment of the invention use is made preferably of multifil tuck threads and blocking threads with a monofil weft thread. The warp threads are preferably likewise made of multifil material. With the device in accordance with the invention this permits production of an excellent webbing, more particularly belt webbing, satisfying all requirements of a good, comfortable webbing, namely soft woven edges the same in appearance whilst featuring high stiffness crosswise in the webbing.

Figure 2:
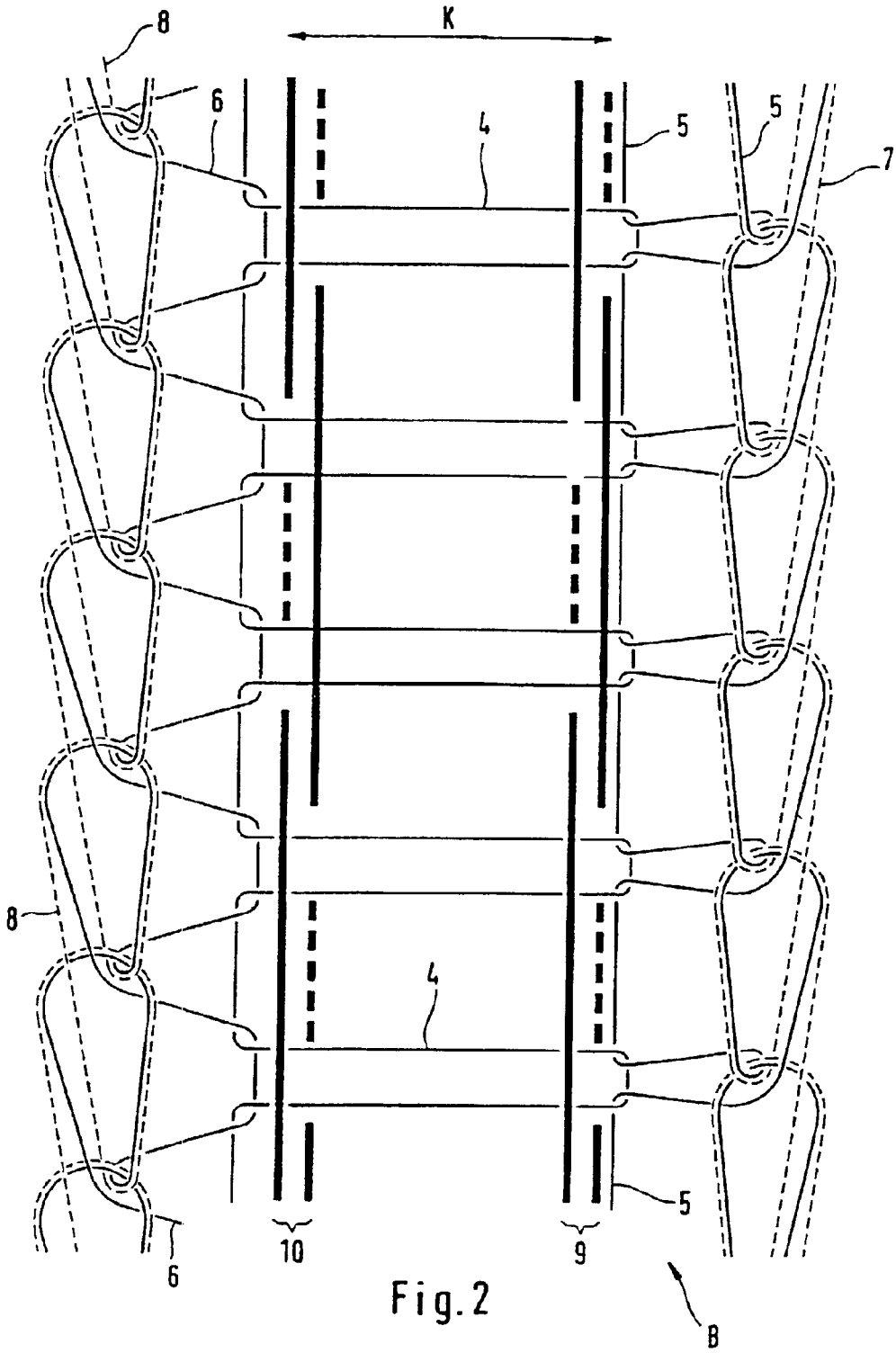
FIG. 2 is a greatly simplified diagrammatic section of a webbing woven by a further embodiment of the method in accordance with the invention including courses of looped tuck/blocking threads, as well as pick needle and knitting needles.

Referring now to FIG. 2 there is illustrated a greatly simplified diagrammatic section of a webbing B woven by a further embodiment of the method in accordance with the invention included courses of looped tuck/blocking threads formed from a left-hand tuck thread 6 and a left-hand blocking thread 8 (indicated by a broken line). In this arrangement the left-hand tuck thread 6 wraps the weft thread 4 whilst the left-hand blocking thread 8 is looped to the left-hand tuck thread 6 such that it comes to rest outside of the weft reversals of the weft thread 4. To make for an uncluttered illustration, of the warp threads KF located in the warp thread portion identified K only the first pair 10 and 9 are shown on both sides of the webbing, the solid lines representing the overlying warp threads 10, 9 and the broken lines representing the underlying warp threads 10, 9. Clearly evident is that the left-hand weft reversal loops have a larger radius than those on the right. The location of the right-hand blocking thread 7 and right-hand tuck thread 5 is analogous to the situation on the left-hand side.

Figure 3:
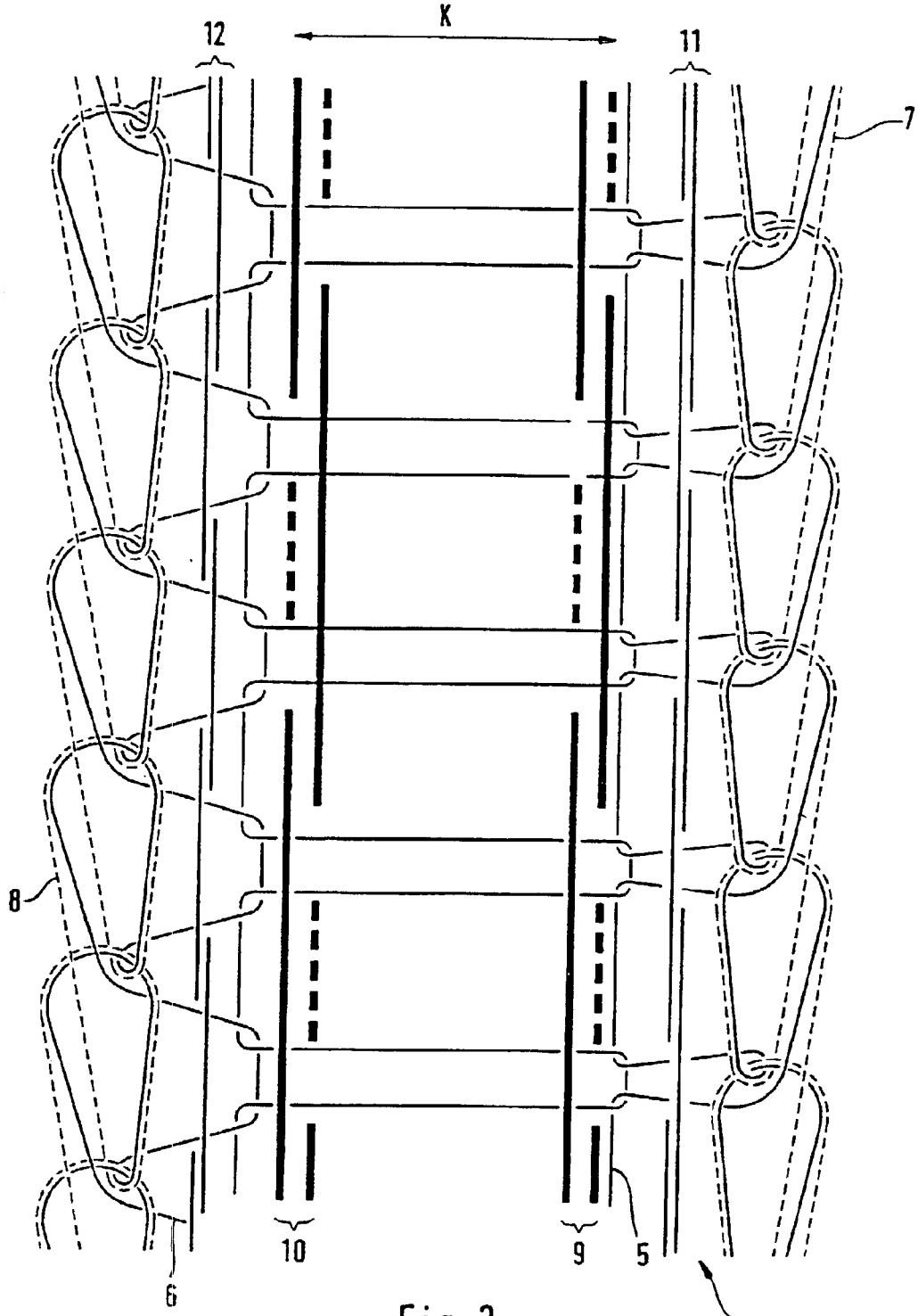
FIG. 3 is an illustration of a webbing as shown in FIG. 2 showing additional threads woven in between the the loop-knitted course and the outermost warp threads, the additional threads intersecting only the "feet" of the looped tuck threads.

Referring now to FIG. 3 there is illustrated an illustration of a webbing B as shown in FIG. 2 showing additional threads 12 and 11 woven in between the loop-knitted course and outermost warp threads 10 and 9, the additional threads intersecting only the "feet" of the looped tuck threads. The inserted additional threads 12 and 11 cover the reversals of the weft thread 4 to the edge of the webbing in thus providing excellent protection of the webbing edge outwardly from the (relatively hard) monofil weft thread 4.

Figure 4:
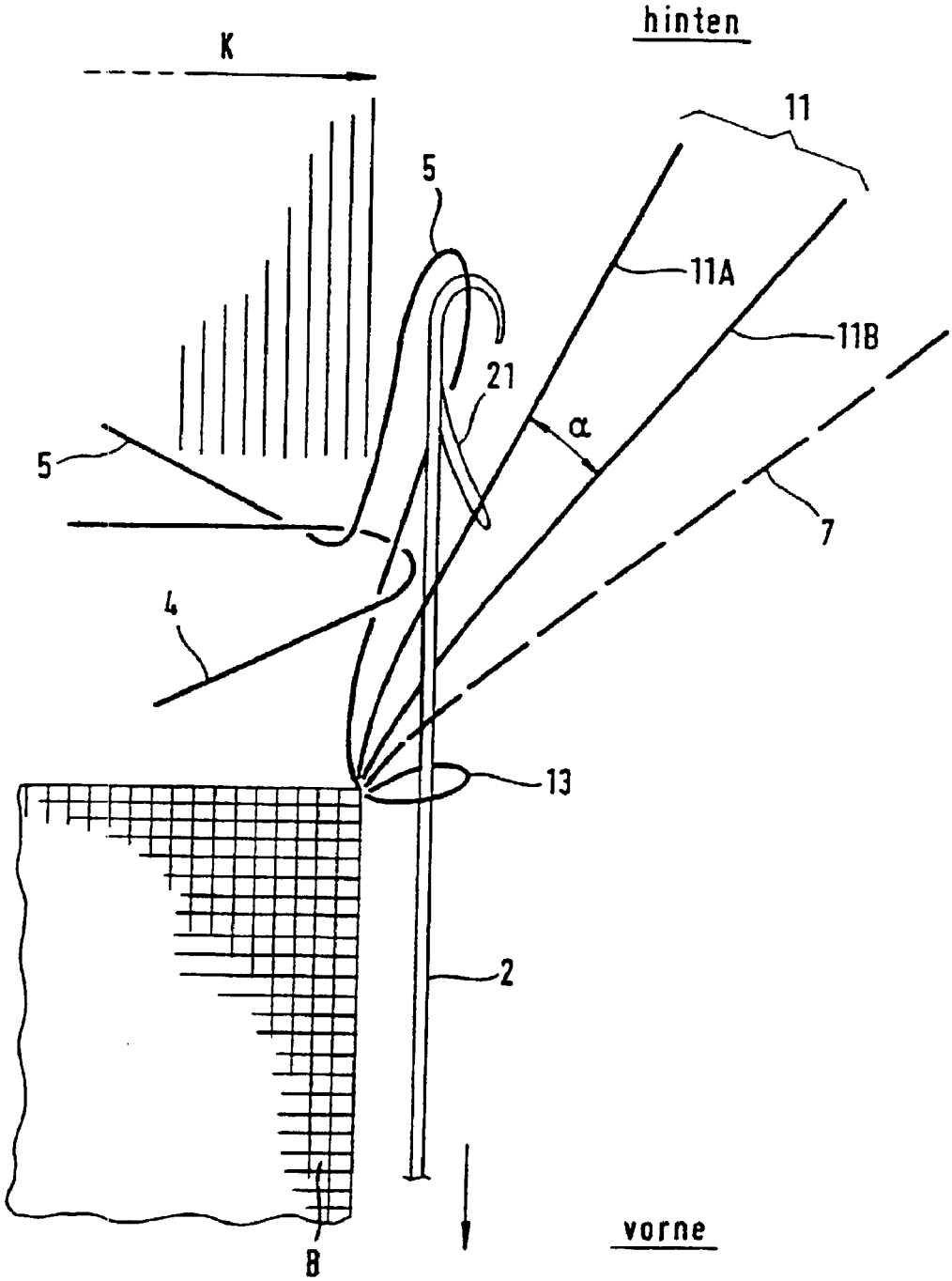
FIG. 4 is a greatly simplified diagrammatic section of the right-hand side of a webbing during the weaving process, the location of the right-hand knitting needle being depicted on its way forwards in relation to the weft thread, the tuck thread, the blocking thread and the additional threads.

Referring now to FIG. 4 there is illustrated a greatly simplified diagrammatic section of the right-hand side of a webbing B during the weaving process, the location of the right-hand knitting needle 2 being depicted on its way forwards in relation to the weft thread 4, the right-hand tuck thread 5, the right-hand blocking thread 7 and the additional threads 11. The right-hand knitting needle 2 has caught the tuck thread 5 presented by the tucker (not shown) in the so-called pick triangle (likewise not shown) before then drawing the tuck thread 5 forwards in taking the weft thread 4 with it. In this arrangement the knitting needle 2, in this case a latch needle, with the latch open passes through and between the additional threads 11 opened by an angle $\alpha$ without gripping the additional threads 11. Following passage of the additional threads 11 the knitting needle 2 grips the blocking thread 7 presented by a blocking thread inserter (not shown) and draws it after closing of the latch 21 together with the tuck thread 5 through an "old" loop 13 located on the knitting needle 2. After this, the knitting needle 2 reverses at the front deadpoint and moves downwards to produce a new loop. Before the knitting needle 2 passes by the additional threads 11 they are crossed so that the additional thread 11A formerly located above (FIG. 4) is now located beneath (not shown) and the additional thread lib formerly located beneath (FIG. 4) is now located above (not shown).

Since the additional threads (more particularly two of which are used at each loop side) are inserted for additional protection of the weft reversals, these threads must not be binded by the weft thread. This is achieved by the additional threads being inserted into the fabric by additional inserters (not shown) which receive their movement by levers (not shown) from either a shank (not shown) employed solely for this function, or from a crank (not shown) or camplate (likewise not shown). The additional inserters have—the same as known elements working e.g. as thread inserters—a hole at their front end serving to receive the thread.

The additional inserters working preferably paired alternatingly one up/one down in synchronism with the weaving machine, are positioned so that the additional threads are overstitched and understitched respectively by the corresponding knitting needle outside of the shed of the weave following tucking of the tuck thread (see also FIG. 4). The procedure as just described is repeated in weaving the webbing as shown roughly in FIG. 3.

The method in accordance with the invention is suitable for producing both a simple webbing and more particularly for producing a belt webbing for seat belt systems.

However, the method in accordance with the invention is just as suitable to advantage—in making use of elastic or elastomeric warp and/or weft threads—for producing elastic or elastomeric webbing, for example for use in making garments, laundry items and especially underwear.

List of Reference Numerals

1 pick needle
2 right-hand knitting needle
3 left-hand knitting needle
4 weft thread
5 right-hand tuck thread
6 left-hand tuck thread
7 right-hand blocking thread
8 left-hand blocking thread
9 outermost right-hand weft threads
10 outermost left-hand weft threads
11 light-hand additional threads
11A right-hand additional thread
11B right-hand additional thread
12 left-hand additional threads
13 right-hand "old" loop
21 right-hand needle latch
B webbing
K warp thread portion
KF warp threads

What is claimed is:

1. A method of producing webbing including warp threads and a weft thread on a narrow fabric needle weaving machine, more particularly a belt webbing for seat belt systems, comprising the following repeat sequence of steps in the method:

a) picking a weft thread (4) with a pick needle (1), b) wrapping the weft thread (4) with a tuck thread (5) furnished from the weft exit side lying opposite the pick side by a knitting needle (2) working at the weft exit side, c) retracting the pick needle (1) and d) wrapping the weft thread (4) with a tuck thread (6) furnished at the pick side by a knitting needle (3) working at the pick side, whereby a monofil thread or a combination of multifil threads and monofil thread is used as the weft thread (4) and the tuck thread (5, 6) in step b) is looped with a blocking thread (7, 8) at the weft exit side and at the pick side, at at least one of the weft entry side and the weft exit side of the webbing between the warp threads (KF) with no wrapping of the weft material linking only the legs of the loops of the tuck thread (5, 6) and the loop course, additional threads (11, 12) substantially located in parallel to the warp threads (KF) in the finished webbing (B) are included in the weave, each blocking thread (7, 8) of each knitting needle (2, 3) being presented such that it comes to rest totally outside of the additional threads (12, 11).

2. The method as set forth in claim 1, characterized in that the weft thread is picked doubled or multiplied.

3. The method as set forth in claim 1, characterized in that substantially fully-shrunk yarns are used for the tuck threads and/or the blocking threads and/or the additional threads.

4. The method as set forth in claim 1, characterized in that for the tuck threads (5, 6) a yarn is selected having a dtex the same or higher than that of the weft thread.

5. The method as set forth in claim 1, characterized in that for the blocking threads (7, 8) a yarn is selected having a dtex the same or higher than that of the tuck thread (5, 6).

6. A device for use on a narrow fabric needle machine for weaving webbing, the device comprising:

a pick needle (1);

at the weft entry side and weft exit side respectively, a knitting needle (2,3), suitable for looping a tuck thread with weft threads and for looping a blocking thread with the tuck thread;

a tucker for presenting the tuck thread; and additional thread inserters working at the weft entry side and/or weft exit side between the tucker and a blocking thread inserter, the additional thread inserters for inserting additional threads (11, 12) between the tuck thread and the blocking thread;

wherein said device presents each blocking thread of each knitting needle such that it comes to rest totally outside of the additional threads.

7. The device as set forth in claim 6, characterized by it including a blocking thread inserter.

8. Webbing comprising warp threads and a weft thread including:

looped tuck threads attached on both sides to the weft thread, additional threads (11, 12) woven substantially in parallel to the warp threads (KF) at, at least one of the weft entry side and the weft exit side of the webbing located between the warp threads (KF) and the loop course without wrapping the weft material in the webbing and linked only to the legs of the loops of the tuck thread (5, 6), and blocking threads (7, 8) located totally outside of the additional threads (12, 11).

9. A webbing as set forth in claim 8, characterized by it being a belt webbing, more particularly for a seat belt system and including substantially inelastic warp threads.

10. The webbing as set forth in claim 8, characterized by it including warp threads and/or additional threads (11) and/or tuck threads (5,6) and/or blocking threads (7,8) of PTFE or coated with PTFE.

11. The method as set forth in claim 2, characterized in that substantially fully-shrunk yarns are used for th tuck threads and/or the blocking threads and/or the additional threads.

12. The method as set forth in claim 2, characterized in that for the tuck (5, 6) a yarn is selected having a dtex the same or higher than that of the weft thread.

13. The method as set forth in claim 3, characterized in that for the tuck threads (5, 6) a yarn is selected having a dtex the same or higher than that of the weft thread.

14. The method as set forth in claim 2, characterized that for the blocking threads (7, 8) a yarn is selected having a dtex the same or higher than that of the tuck thread (5, 6).

15. The method as set forth in claim 3, characterized in that for the blocking threads (7, 8) a yarn is selected having a dtex the same or higher than that of the tuck thread (5, 6).

16. The webbing as set forth in claim 9, characterized by it including wrap threads and/or additional threads (11) and/or tuck threads (5, 6) and/or blocking threads (7, 8) of PTFE or coated with PTFE.

* * * * *